US005888115A

United States Patent [19]

Shoemaker, Jr. et al.

[11] Patent Number: 5,888,115

[45] Date of Patent: Mar. 30, 1999

[54] INTERACTIVE FUNNEL AMUSEMENT DEVICE

[75] Inventors: Stephen P. Shoemaker, Jr., Redondo Beach; Ken Y. Hata, Saratoga; Norman B. Petermeier, Pleasanton, all of Calif.

[73] Assignee: RLT Acquisition, Inc., Pleasanton, Calif.

[21] Appl. No.: 67,405

[22] Filed: Apr. 28, 1998

Related U.S. Application Data

[60] Provisional application No. 60/066,359 Nov. 20, 1997.

[51] Int. Cl.[6] ..... A63H 29/08; A63H 29/00; A63H 33/00; A45C 1/12

[52] U.S. Cl. ..... 446/168; 446/8; 446/429; 446/489

[58] Field of Search ..... 446/8, 10, 11, 446/168, 167, 166, 169–174, 431, 435, 444, 429, 489; 273/120 R, 124 R, 348, 371, 374, 375, 378, 386; 194/344, 346, 347; D99/34, 35, 36; 473/109

[56] References Cited

U.S. PATENT DOCUMENTS

| | | | |
|---|---|---|---|
| D. 289,218 | 4/1987 | Divnick . | |
| D. 378,464 | 3/1997 | Perkitny . | |
| 467,676 | 1/1892 | Schneider | 273/120 R X |
| 917,629 | 4/1909 | Long | 194/344 X |
| 1,572,090 | 2/1926 | Smith | 194/344 X |
| 2,430,658 | 11/1947 | Andres | 194/344 X |
| 3,092,928 | 6/1963 | Geiser | 446/168 |
| 3,559,990 | 2/1971 | Philpot | 473/109 |
| 3,581,430 | 6/1971 | Glass | 446/11 |
| 3,686,789 | 8/1972 | Polonyi | 446/168 |
| 3,807,738 | 4/1974 | Breslow | 273/120 R X |
| 3,949,990 | 4/1976 | Polony | 446/468 X |
| 3,970,310 | 7/1976 | Gryschuk | 273/375 |
| 4,324,059 | 4/1982 | Baum . | |
| 4,762,512 | 8/1988 | Divnick . | |
| 4,770,527 | 9/1988 | Park | 473/459 X |
| 4,871,055 | 10/1989 | Poythress et al. . | |
| 4,923,201 | 5/1990 | Nichol et al. | 273/371 |
| 5,029,863 | 7/1991 | Kraczyk | 273/124 R X |
| 5,071,127 | 12/1991 | Bromley et al. | 273/85 A |
| 5,511,794 | 4/1996 | Katamoto | 273/440 |

*Primary Examiner*—D Neal Muir
*Attorney, Agent, or Firm*—Hickman & Martine, LLP

[57] ABSTRACT

The present invention provides an interactive funnel amusement device. The interactive funnel amusement device allows a user to interact with the interactive funnel amusement device to a greater extent than prior art funnel devices. In one embodiment, the interactive funnel amusement device includes a funnel and a target. The target is located on an interior surface of the funnel such that when an object is rolled along the interior surface of the funnel the object is capable of interacting with the target. The interactive funnel amusement device can also include an adjustable guide. The adjustable guide is capable of guiding the object along one of a number of trajectories along the funnel such that the object rolls around the interior surface of the funnel in a substantially spiral manner. The adjustable guide can also be used to aim the object along a trajectory that causes the object to interact with the target located on the interior surface of the funnel. The trajectory of the object may be varied along the horizontal plane, vertical plane and in the angular orientation of the object.

50 Claims, 12 Drawing Sheets

INTERACTIVE FUNNEL AMUSEMENT DEVICE

CROSS REFERENCE TO RELATED APPLICATIONS

The present application claims benefit of U.S. Provisional Patent Application Ser. No. 60/066359, entitled "Interactive Funnel Amusement Device", by Stephen P. Shoemaker, Jr., Ken Y. Hata and Norman B. Petenneier, filed Nov. 20, 1997, which is incorporated herein by reference in its entirety.

BACKGROUND OF THE INVENTION

1. Field of the Invention

This invention relates generally to amusement devices, and more particularly to funnel type amusement devices.

2. Description of the Related Art

Since the beginning of time, man has been fascinated by physical phenomena. Whether it is the effect of gravity on light and heavy items, or the coriolis effect, people have been amused by the intricacies of nature. One particular phenomenon that continues to amuse people is the display of centripetal force.

The funnel is one particular application of centripetal force used to provide amusement. Funnel amusement devices typically take the form of those disclosed by U.S. Pat. No. 4,762,512 by Divnick, U.S. Pat. No. 4,871,055 by Poythres et al., and U.S. Pat. No. D289,218 by Divnick. As is discussed below, the prior art funnel amusement devices do nothing more than display a rolling coin.

FIG. 1*a* shows a typical prior art funnel amusement device 8. Funnel amusement device 8 includes a fixed coin guide 12 and a funnel 10. Funnel 10 has an upper aperture 15 and a lower aperture 16, the funnel sloping inwardly and downwardly from upper aperture 15 towards lower aperture 16. Typically, a coin 14 is dropped onto fixed coin guide 12. Fixed coin guide 12 then guides coin 14 onto a trajectory along the inner surface of funnel 10, such that coin 14 will spiral down from the upper aperture 15 to lower aperture 16, as can be seen in reference to FIG. 1*b*. However, fixed coin guide 12 does not allow the user to vary the path or speed of coin 14.

FIG. 1*b* is a cross-sectional side view of funnel 10 taken along line 1*b*—1*b* of FIG. 1*a*. Funnel 10 has an inner surface 10*a* and an outer surface 10*b*. Coin 14, once it has been guided onto inner surface 10*a* by fixed coin guide 12, typically rolls down funnel 10 in a spiral pattern A as depicted in FIG. 1*b*. Coin 14 initially begins rolling with a near vertical orientation along inner surface 10*a*. However, as coin 14 spirals down inner surface 10*a* it obtains a more horizontal orientation. Due to centripetal force, coin 14 is able to roll along inner surface 10*a* even though coin 14 is no longer vertically oriented. As coin 14 continues to roll further down funnel 10, coin 14 will gradually become more horizontally oriented. Not until coin 14 approaches lower aperture 16, when coin 14 is almost completely horizontally orientated, does coin 14 succumb to gravity and fall over. The spiral voyage of coin 14 from coin guide 12 entertains viewers of the device 8.

Despite the pleasure and enjoyment provided by prior art funnel amusement devices, there is room for improvement. First, fixed coin guide 12 is typically limited to rolling coin 14 in only one trajectory along funnel 10. Usually, the trajectory is chosen to launch coin 14 on a path that will allow coin 14 to roll the greatest distance along inner surface 10 and provide the greatest length of entertainment. Typical prior art funnel amusement devices are not capable of allowing a variety of different coin trajectories for viewers to enjoy.

Another problem with prior art funnel amusement devices is the limited amount of interaction between the observer and the amusement device. Generally, interaction is limited to dropping coin 14 down fixed coin guide 12. It is desired to allow observers to become more than passive viewers of such amusement devices, and become active participants in the marvels of physics that are being demonstrated.

Additionally, the amusement provided by prior art funnel amusement devices is limited to the rolling of coin 14. The ability to provide further enjoyment and entertainment is always a goal of amusement devices. Thus, there is a need for a more interactive and entertaining funnel amusement device.

SUMMARY OF THE INVENTION

The present invention provides an interactive funnel amusement device. The invention allows a user to interact with the interactive funnel amusement device to a greater extent than prior art funnel devices.

In one embodiment, the interactive funnel amusement device includes a funnel and a target. The funnel is substantially circular and includes an interior surface and a first and a second openings, where the first opening is larger than the second opening and the first opening is oriented vertically above the second opening. The funnel slopes from the first opening to the second opening such that an object moves around the interior surface in a substantially spiral manner from the first opening toward the second opening. The target is located on the interior surface of the funnel such that when the object moves around the interior surface of the funnel, the object is capable of interacting with the target.

The interactive funnel amusement device can also include an adjustable guide. The adjustable guide is capable of aiming the object along one of a number of trajectories along the funnel such that the object moves around the interior surface of the funnel in a substantially spiral manner. The adjustable guide can also be used to aim the object along a trajectory that causes the object to interact with the target located on the interior surface of the funnel. In one embodiment, the adjustable guide includes a guide member and an extended guide member. The object is inserted in the guide member and passed along to the extended guide member, where the extended guide member reorients the motion of the object. In alternate embodiments, the reorientation of the motion of the object may be in the horizontal plane, the vertical plane or the angular orientation of the object.

In one embodiment, the guide is an improved coin guide that includes a coin rejecter and a coin deflector. The coin rejecter rejects inappropriately-sized coins inserted into the coin guide. A rejected coin is bounced off the coin deflector such that the rejected coin is prevented from interacting with the interactive funnel amusement device.

Therefore, the present invention advantageously provides an interactive funnel amusement device. The interactive funnel amusement device allows a user to aim a coin along a number of different paths along the funnel. One or more targets are included with objectives during a game played on the device. The user may exercise skill in choosing one of a substantial number of paths to attempt to interact the coin with the targets. A skillful user is rewarded with lights, sounds and prizes. These and other advantages of the present invention will become apparent to those skilled in the art upon a study of the specification and drawings describing the present invention.

BRIEF DESCRIPTION OF THE DRAWINGS

The invention, together with further aspects and advantages thereof, may best be understood by reference to the following description taken in conjunction with the accompanying drawings in which.

DETAILED DESCRIPTION OF THE INVENTION

The present invention will now be described in detail with reference to exemplary preferred embodiments as illustrated in the accompanying drawings. In the following description, numerous specific details are set forth in order to provide a thorough understanding of the present invention. It will be apparent, however, to one skilled in the art, that the present invention can be practiced without some or all of these specific details. In other instances, well known process steps have not been described in detail in order to not unnecessarily obscure the present invention.

The present invention provides an interactive funnel amusement device. One embodiment of the present invention allows a user to aim a rolling or sliding object along several trajectories within a funnel. In another embodiment, targets are provided within the funnel such that the rolling or sliding object interacts with the targets. By triggering targets the user may be rewarded with tokens or prizes. In a further embodiment, the rolling or sliding object may be aimed along several trajectories in order to interact with targets within the funnel.

By providing the users the ability to aim, and targets for the rolling or sliding object to interact with, the present invention provides an increased level of interaction between a user and the interactive funnel amusement device. The increased level of interaction provides even further enjoyment to users and observers alike. Additionally, the added interaction allows the present invention to provide additional feedback to users, typically in the form of prizes, tokens or other awards.

Figure 1A:
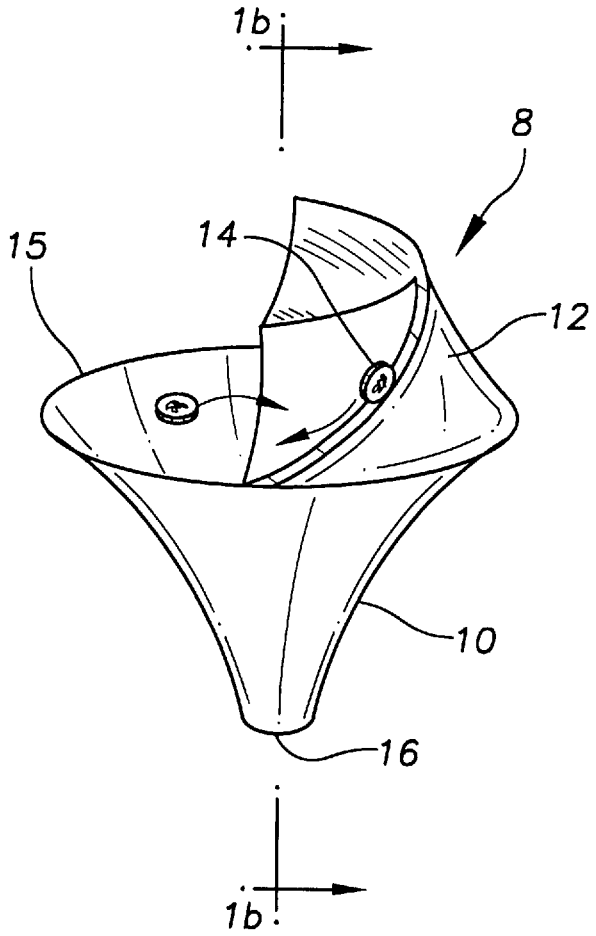
FIG. 1a PRIOR ART
FIG. 1*a* shows a typical prior art funnel amusement device.
Figure 1B:
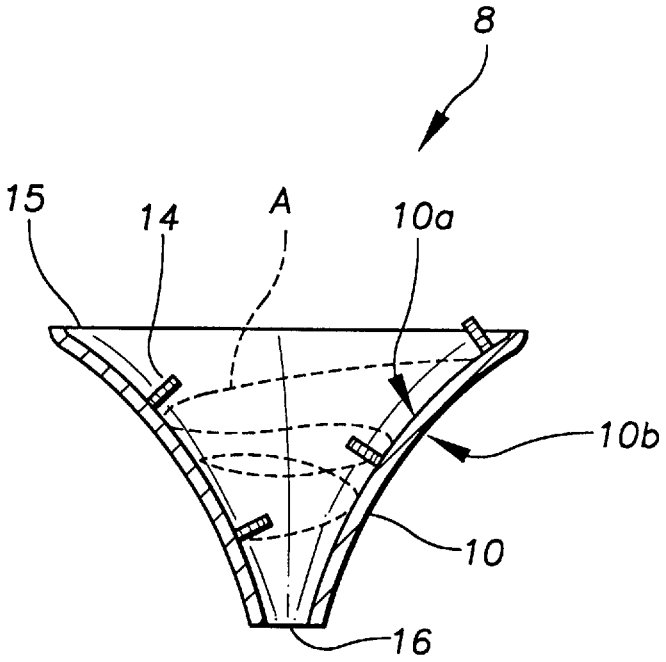
FIG. 1b PRIOR ART
FIG. 1*b* is a cross-sectional side view of the funnel of FIG. 1*a* taken along lines 1*b*—1*b*.
Figure 2:
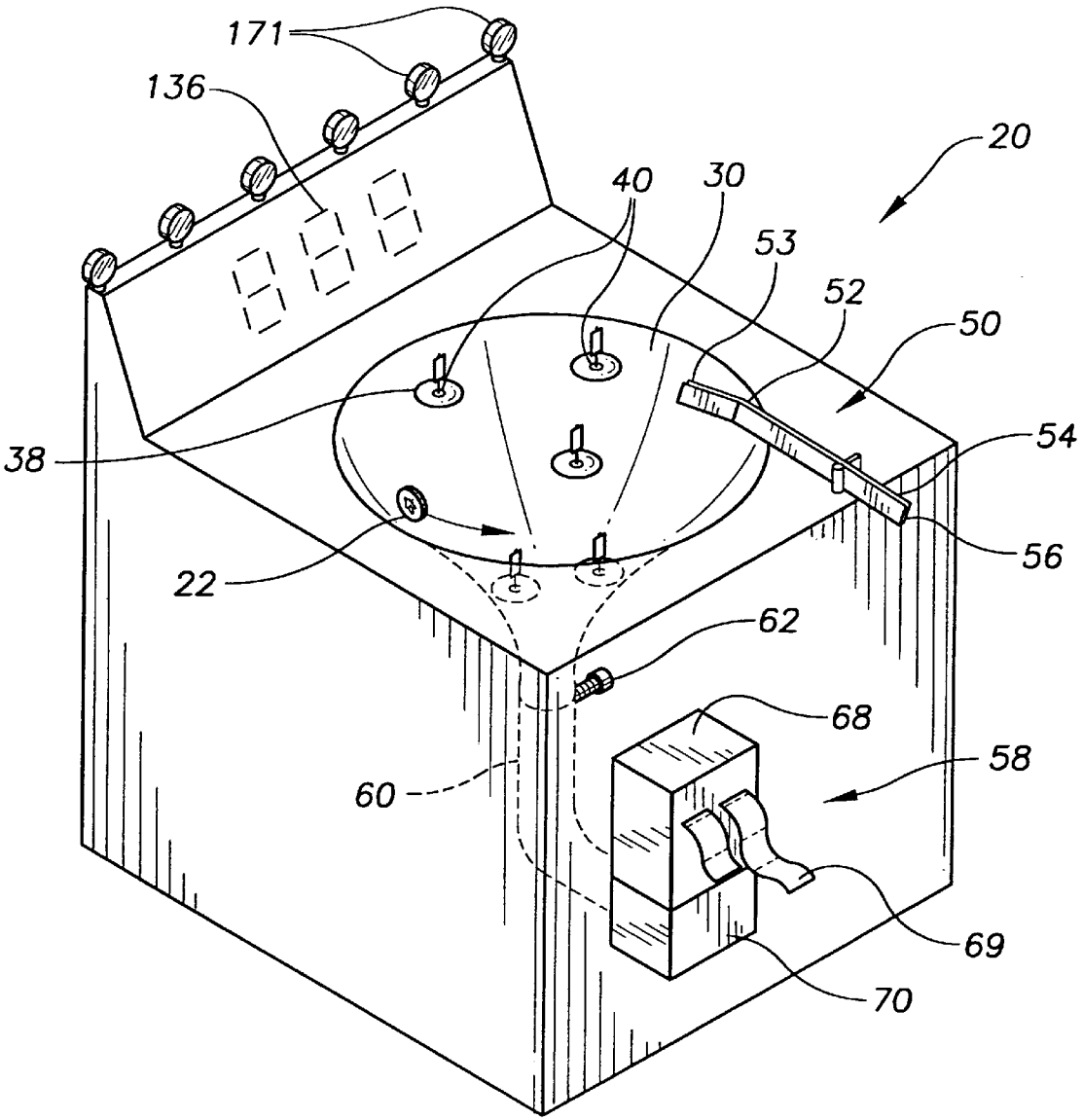
FIG. 2 is an interactive funnel amusement device, in accordance with an embodiment of the present invention.

One example of an interactive funnel amusement device is shown in FIG. 2. FIG. 2 is an interactive funnel amusement device 20, in accordance with an embodiment of the present invention. Interactive funnel amusement device 20 includes a funnel 30. Along the inner surface of funnel 30 are located several targets 40. Interactive funnel amusement device 20 also includes an adjustable coin guide 50. Adjustable coin guide 50 may be used to aim a coin 22, or other type of rolling or sliding object or playing piece, along one of many trajectories along funnel 30. By way of example, balls, discs, cylinders, wheels, wheeled objects, smooth objects or any other suitable object capable of rolling or sliding along funnel 30 can be used.

A user may then not only obtain the amusement of watching a coin roll along the inner surface of funnel 30, but also receive the added enjoyment of actually aiming the coin along funnel 30. Additionally, the user can use adjustable coin guide 50 to guide coin 22 along funnel 30 in order to hit or interact with targets 40. After coin 22 has been guided along funnel 30 it will eventually drop through the bottom of the funnel. A coin sensor 62 senses the dropping of the coin through funnel 30. Coin 22 may then travel through a tube 60 to end up in a collection box 70. Coin sensor 62 may be coupled to a ticket dispensing device 68, such that when the coin has been sensed dropping through funnel 30, ticket dispensing device 68 may dispense tickets 69 or other award, to the user. Targets 40 may also be coupled to ticket dispensing device 68 such that when the user has caused coin 22 to interact with one or more of targets 40, ticket dispensing device 68 receives a signal or indication from the interacted targets to cause further tickets 69 to be dispensed. The tickets may be dispensed by actuating a dispensing motor 58 (not shown).

Interactive funnel amusement device 20 may also include a central processing unit (CPU) or other control circuitry (not shown) that is coupled to all the various features of interactive funnel amusement device 20 to provide and control a complete system, as discussed in further detail below. Additionally, interactive funnel amusement device 20 can include a display 141, lights 171 and illuminating indicators 38 located around targets 40 The CPU can control the appearance of display 141, lights 171 and illuminating indicators 38 to provide a more exciting experience for the user and observers.

Figure 3:
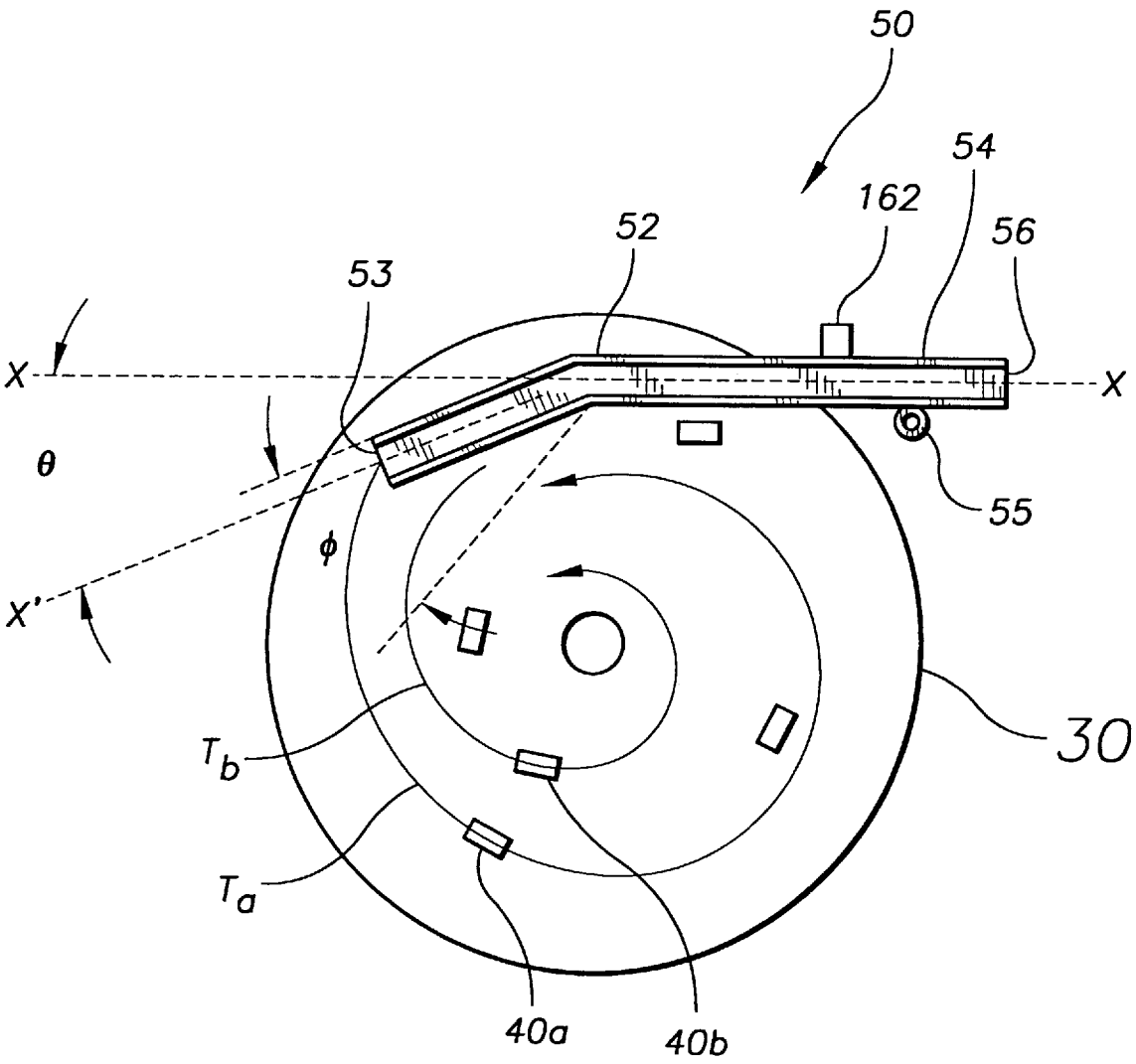
FIG. 3 is a top view of the funnel and adjustable coin guide of the interactive funnel amusement device of FIG. 2, in accordance with an embodiment of the present invention.

FIG. 3 is a top view of funnel 30 and adjustable coin guide 50 of the device 20 of FIG. 2. Funnel 30 includes several targets 40, for example targets 40*a* and 40*b*. Adjustable coin guide 50 includes a coin guide member 54, an extended coin guide member 52 and a hinge 55. Hinge 55 is coupled to coin guide member 54 such that the entire coin guide 50 can be adjusted to vary its angle in relation to an axis X. Extended coin guide member 52 is angled such that a distal end 53 of the extended coin guide member 52 is angled from axis X by angle θ. Axis X' represents the new orientation given to any coin or rolling device that is passed through adjustable coin guide 50. By adjusting or pivoting adjustable coin guide 50, a coin or other rolling device can be aimed along several trajectories starting within an angle Ø.

In one embodiment, coin guide 50 is suitable for aiming a coin, or other disc-like object. Coin guide 50 can also be twisted to impart a tilt to the coin passed through coin guide 50, which is discussed further in reference to FIGS. 4*c* and 4*d*. Coin 22 is thereby reoriented to be orthogonal to the surface of funnel 30 as the coin exits coin guide 50. In another embodiment, extended coin guide member 52 is twisted, while coin guide member 54 is substantially straight.

The characteristics of the possible trajectories are dependent upon the speed of coin 22 as it exits coin guide 50 and the dimensions of funnel 30. In one embodiment, coin guide 50 is sloped down from a proximal end 56 of coin guide 50 to distal end 53. The slope of coin guide 50 imparts a velocity on coin 22 as it travels down the coin guide and exits distal tip 53.

By way of example, a coin can be guided along trajectories $T_A$ or $T_B$. By guiding the coin along different trajectories, the user may be able to interact the coin with different targets 40. By way of example, if a coin is guided along trajectory $T_A$ the coin may be aimed to interact with target 40*a*. If a coin is guided along trajectory $T_B$ the coin can be guided to interact with target 40*b*. By guiding coin 22 along the other possible trajectories, a user may be able to cause coin 22 to interact with the other targets 40.

Figure 4A:
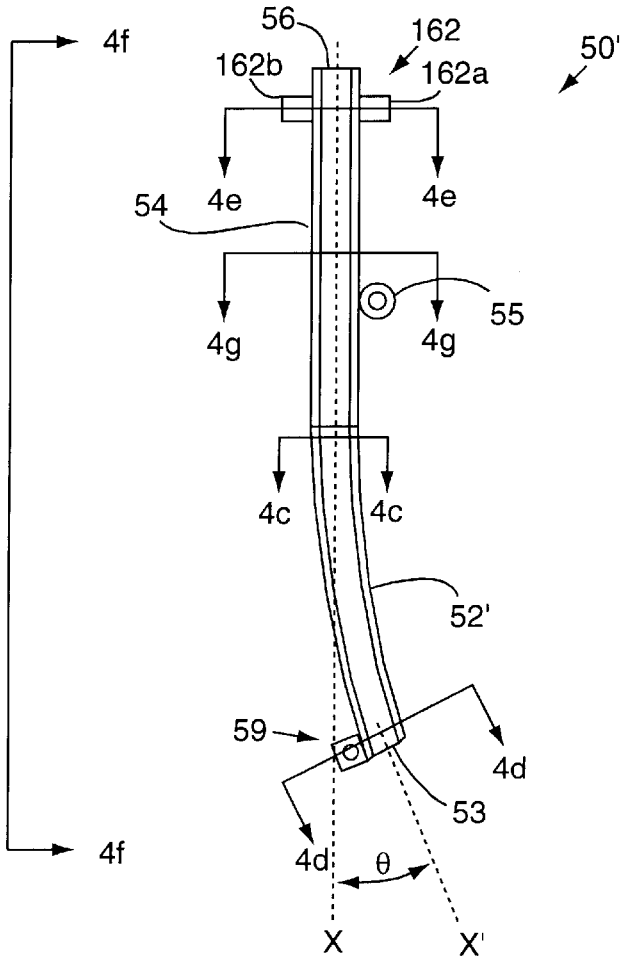
FIG. 4*a* shows a coin guide with a curved extended guide member, in accordance with an embodiment of the present invention.
Figure 4B:
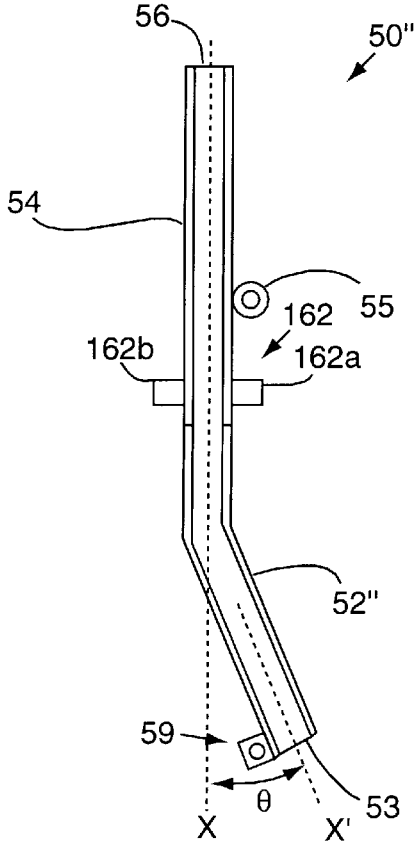
FIG. 4*b* shows a coin guide with an angled extended guide member, in accordance with an embodiment of the present invention.

A feature of the present invention is the ability to guide a coin or other rolling or sliding object along different trajectories along funnel 30. The ability to aim a coin along different trajectories is provided by an adjustable coin guide 50, now referring to FIGS. 4*a* and 4*b*. FIG. 4*a* shows an adjustable coin guide 50' including an extended coin guide member 52' in accordance with an embodiment of the present invention. Adjustable coin guide 50' also includes a coin guide member 54 coupled to a hinge 55. Hinge 55 allows adjustable coin guide 50' to pivot about the axis A extending through hinge 55. Hinge 55 may be located anywhere along coin guide 54 so long as adjustable coin guide 50' is allowed to move freely along the plane orthogonal to the axis of hinge 55.

Adjustable coin guide 50 can be sloped from a proximal end 56 of coin guide member 54 to the distal end 53 of extended coin guide member 52'. The sloping of adjustable coin guide 50 allows coin 22 to be placed into the proximal end 56 of coin guide member 54 and roll along adjustable coin guide member 50' to exit out the distal end 53 of extended coin guide member 52'. Once coin 22 has entered coin guide member 54, it is guided through the length of coin guide member 54 and into extended coin guide member 52'. Extended coin guide member 52' reorients the motion of the coin traveling along axis X to axis X'. The angle θ between axis X and axis X', may be any suitable angle so long as a coin, or other rolling or sliding object guided along adjustable coin guide 50' will obtain a trajectory that allows the coin to spiral down funnel 30 in an appropriate manner.

FIG. 4*a* depicts an extended coin guide member 52' that is substantially curved and twisted to provide the reorientation of a coin. However, referring to FIG. 4*b*, extended coin guide member 52 can alternatively be angled, shown as extended coin guide member 52" in an adjustable coin guide 50". Extended coin guide member 52 can be any suitable angled extended guide. In another embodiment, extended coin guide member 52 is substantially straight.

Figure 4C:
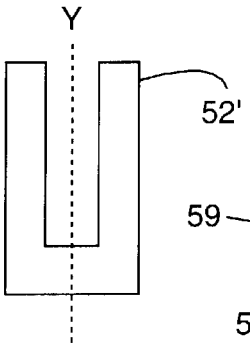
FIG. 4*c* is a cross-sectional view of the extended coin guide of FIG. 4*a* taken along lines 4*c*—4*c*.
Figure 4D:
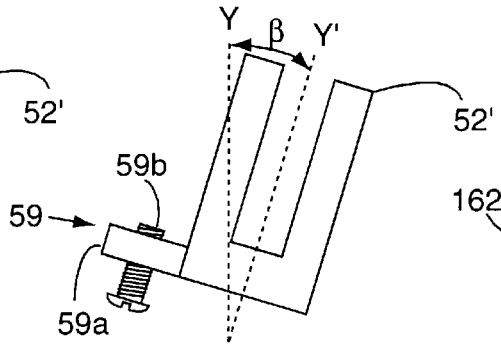
FIG. 4*d* is a cross-sectional view of the extended coin guide of FIG. 4*a* taken a long lines 4*d*—4*d*.

In yet another embodiment, coin guide 50 is twisted in order to tilt the coin being passed through the coin guide, as seen in reference to FIGS. 4*c* and 4*d*. FIGS. 4*c* and 4*d* are cross-sectional views of extended coin guide 52' of FIG. 4*a* taken along lines 4*c*—4*c* and 4*d*—4*d*, respectively. FIG. 4*c* is a cross-section of extended coin guide member 52' near the juncture between coin guide member 54 and extended coin guide member 52'. The orientation of extended guide member 52' at that point is parallel to a Y axis, which is substantially vertical. A vertical orientation is typically most usefull to allow an operator to insert a coin, or other rolling or sliding object.

FIG. 4*d* is a cross-section of extended coin guide member 52' near its distal end 53. The orientation of extended guide member 52' at that point is parallel to an axis Y'. Y' is tilted from the Y axis by an angle β. Angle β is such that coin 22 passed through coin guide 50 is oriented to be substantially orthogonal to the plane of the upon exit from the coin guide. By way of example, angle β can be 10 to 30 degrees, depending upon the slope of funnel 30. Thus, if funnel 30 is sloped 20 degrees from the horizontal towards its upper end, angle β would be approximately 20 degrees. In that case, coin 22 is tilted 20 degrees and would be vertically orthogonal to the plane of funnel 30 upon exit. In another embodiment, the entire coin guide 50 is tilted, which imparts a tilt upon the coin, or other rolling or sliding object.

Figure 4E:
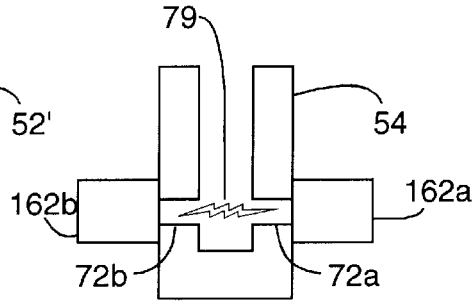
FIG. 4*e* is a cross-section of the coin guide member of FIG. 4*a* taken along lines 4*e*—4*e*.

Referring to FIG. 4*e*, in a further embodiment, coin guide 50 includes a coin guide switch 162 that senses the insertion of a coin. FIG. 4*e* is a cross-section of coin guide member 54 of FIG. 4*a* taken along line 4*e*—4*e*. Although coin switch 162 is located towards the proximal end of coin guide member 54, coin switch 162 can be placed at any suitable point along the length of coin guide 50.

Coin switch 162, in one embodiment, can be an emitter-detector including emitter 162*a* and detector 162*b*. Emitter 162*a* and detector 162*b* are located at opposite apertures 72*a* and 72*b*, respectively, in coin guide member 54. Apertures 72*a* and 72*b* are oppositely aligned such that a line of vision is created laterally through coin guide member 54. Emitter 162*a* passes an electromagnetic signal 79 through apertures 72*a* and 72*b* such that any object passing th rough coin guide member 54 interacts with electromagnetic signal 79. Detector 162*b* detects the electro-magnetic signal, and interruptions thereof. When coin 22 is passed through coin guide 50, the coin interacts with the electro-magnetic signal and is detected by coin switch 162. The coin switch can be coupled to a CPU or other control circuitry to relay information to the CPU when a coin is detected. By way of example, electromagnetic signal 79 may be an optical signal, an infra-red signal, an ultra-violet signal, a radio frequency signal or any other suitable type of signal.

Figures 4F, 4G, 4H:
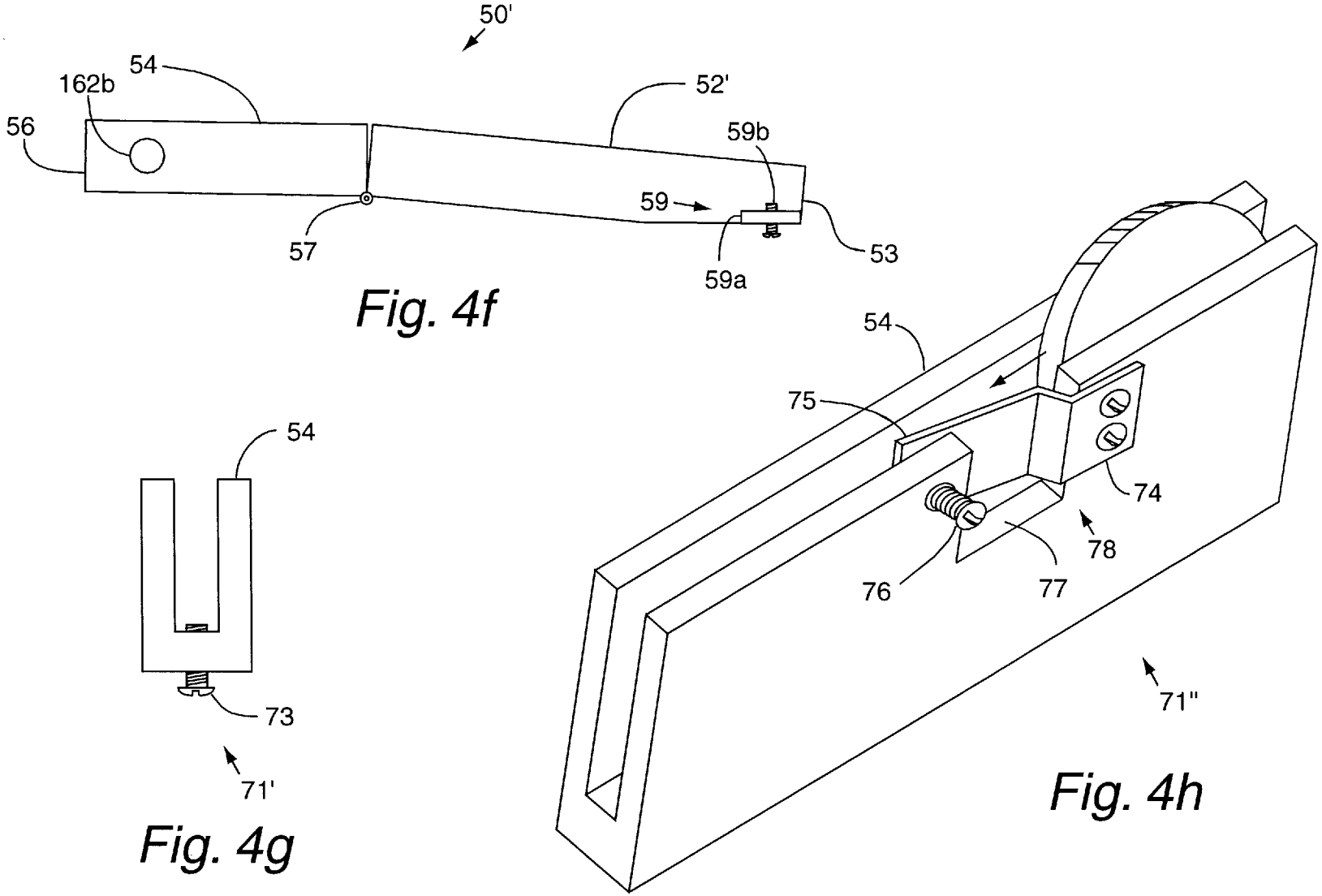
FIG. 4*f* is a side view of the coin guide of FIG. 4*a* taken along lines 4*f*—4*f*.
FIG. 4*g* is a cross-section of the coin guide member of FIG. 4*a* taken along the lines 4*g*—4*g*.
FIG. 4*h* is an alternative embodiment of a coin speed adjuster in accordance with the present invention.

Another variation of the present invention includes a level adjuster 59, referring to FIGS. 4*d* and 4*f*. FIG. 4*f* is a side view of coin guide 50' of FIG. 4*a* taken along lines 4*f*—4*f*. In an alternate embodiment, coin guide member 54 can be pivotally coupled to extended coin guide member 52' by a pivot hinge 57 in the longitudinal orientation. Pivot hinge 57 allows for different elevations and angles between coin guide member 54 and extended coin guide member 52, relative to each other. In one embodiment coin guide member 54 and extended coin guide member 52' are fixedly coupled in the lateral axis in order to provide accurate aiming, although the present invention is not so limited.

Pivot hinge 57 allows extended coin guide member 52' to be adjusted in the vertical direction; and level adjuster 59 sets the elevation and angle of extended coin guide member 52'. Level adjuster 59 can be located anywhere along the length of extended coin guide member 52'. In a preferred embodiment, level adjuster 59 is located substantially at the distal end 53 of extended guide member 52'.

Referring back to FIG. 4*d*, in one embodiment, level adjuster 59 includes a flange member 59*a* and an adjustment screw 59*b*. Flange member 59*a* can be a flange that is a part of, or fixedly coupled to extended coin guide member 52'. Flange member 59*a*extends laterally out from extended coin guide member 52'. Adjustment screw 59*b* is mated with an aperture in flange member 59*a*. In the illustrated embodiment, adjustment screw 59*b* rests on the funnel, and by adjusting screw 59*b*, the angle of extended coin guide member 52' in relation to coin guide member 54 is adjusted.

In a variation of the present invention, adjustment screw 59*b* can also control the tilt of the extended coin guide member. Pivot hinge 57 can be configured to allow extended coin guide member 52 to rotate axially as well as vertically. By way of example, pivot hinge 57 can be a ball hinge allowing at least the two degrees of freedom. Thus, in addition to the twist of extended coin guide member 52, the extended coin guide member can be slightly askew from coin guide member 54. The angle of skew can be any suitable angle so long as the motion of the coin is not impeded. To facilitate the skew the opening of the channel of the extended coin guide member adjacent to coin guide member 54 can be tapered.

Yet another feature of the present invention is a coin speed adjuster, referring to FIGS. 4*g* and 4*h*. FIG. 4*g* is a cross-section of coin guide member 54 of FIG. 4*a* taken along the line 4*g*—4*g*. In one embodiment, coin guide member 54 includes a coin speed adjuster 71'. In the illustrated embodiment, coin speed adjuster 71' includes a speed adjustment screw 73. As the coin passes down coin guide member 54, the coin may increase in speed, either due to the slope of coin guide member 54 or due to other means of propulsion. In order to regulate the speed of the coin speed adjustment screw 73 is matingly coupled to coin guide member 54 such that it protrudes into the channel of the coin guide member. The coin passes over speed adjustment screw 73, which slows down the coin. Speed adjustment screw 73 can be adjusted to protrude more or less into the channel of the coin guide member to increase or decrease the amount of slowing imparted on the coin.

The illustrated embodiment depicts the coin speed adjuster as being located at the mid-length of coin guide member 54, although, coin speed adjuster 71 can be located at any suitable point along the length of coin guide 50.

FIG. 4*h* is an alternative embodiment of a coin speed adjuster 71" in accordance with the present invention. Coin speed adjuster 71" includes a spring 78 and a spring adjustment screw 76. Spring 78 includes a plate portion 74 and a spring portion 75. Plate portion 74 and spring portion 75 are offset from each other. Plate portion 74 is fixedly coupled to coin guide member 54 and spring portion 75 protrudes into the channel of coin guide member 54 through an aperture 77.

Spring adjustment screw 76 is matingly coupled through coin guide member 54 such that it protrudes into the channel of the coin guide member. The spring adjustment screw protruding into the channel is in contact with spring portion 75 of spring 78. Spring adjustment screw 76 adjusts how far spring portion 75 protrudes into the channel of coin guide member 54. As the coin, or other rolling or sliding object, rolls down coin guide member 54 it comes into contact with spring portion 75. The interaction slows down the motion of the coin. By adjusting spring adjustment screw 76 the coin's speed can be adjusted.

Another novel aspect of the present invention is the inclusion of targets 40 along the inner surface of funnel 30. Prior art funnel amusement devices lack any type of interaction between a user, coin and funnel, other than simply allowing a coin to roll along the inner surface of the funnel when the coin is "in play". In the present invention, targets 40 are provided along the inner surface of funnel 30 to provide greater interaction between the user and the coin, as depicted in FIGS. 2 and 3.

Figure 5A:
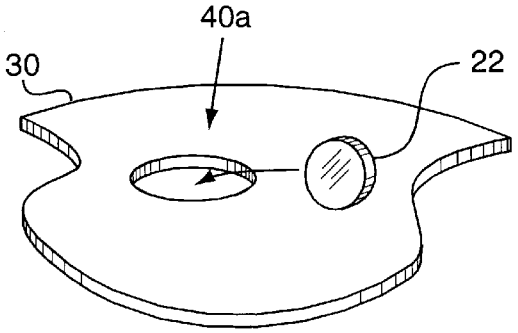
FIG. 5*a* shows a target that is a hole target located on a portion of a funnel, in accordance with an embodiment of the present invention.

FIGS. 5*a*–5*i* depict several different types of targets 40, in accordance with alternate embodiments of the present invention. FIG. 5*a* shows a target that is a hole 40*a* located on a portion of funnel 30, in accordance with an embodiment of the present invention. Coin 22 may have been guided along a trajectory along funnel 30 such that coin 22 interacts with hole 40*a*. For example, the coin 22 may fall into hole 40*a*. Within hole 40*a* a sensor (not shown) can be positioned that will detect the dropping of coin 22 into hole 40*a*. The sensor may then relay that information to a CPU (not shown) or other control circuitry that is a part of interactive funnel amusement device 20.

Figure 5B:
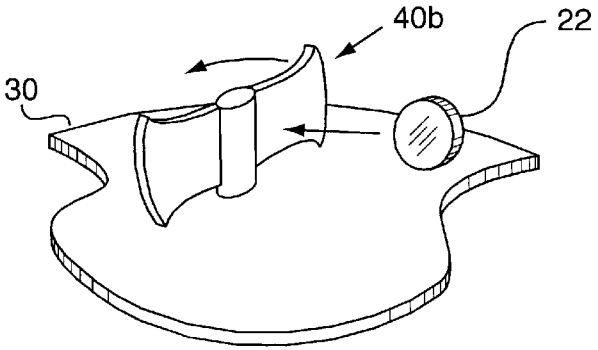
FIG. 5*b* shows a target that includes a paddle target, in accordance with an embodiment of the present invention.

FIG. 5*b* shows a target that includes a paddle 40*b*, in accordance with another embodiment of the present invention. A user may guide coin 22 to interact with paddle 40*b*. Coin 22 may impact one of two sides of paddle 40*b*, causing the paddle to rotate in the appropriate direction. Once again, a sensor may be coupled to paddle 40*b* to detect the interaction between coin 14 and paddle 40*b*.

Figure 5C:
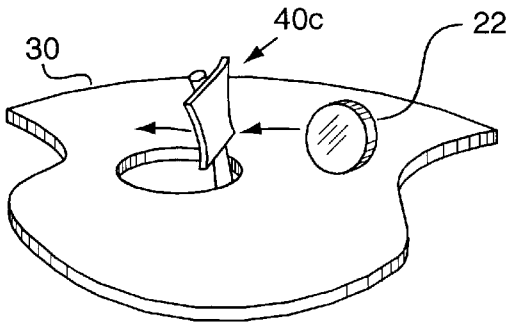
FIG. 5*c* shows a target that includes a movable target located within a hole, in accordance with an embodiment of the present invention.

FIG. 5*c* shows a target that includes a movable target 40*c* located within a hole 42, in accordance with another embodiment of the present invention. A user may guide coin 22 to impact movable target 40*c*. The interaction between coin 22 and movable target 40*c* causes moveable target 40*c* to be propelled to one side of hole 42. However, moveable target 40*c* may be spring-biased to allow movable target 40*c* to rebound and retain its original position within hole 42. One aspect of the particular embodiment of a target 40 is that coin 22 is not significantly impeded from its path along funnel 30. That is, once coin 22 has interacted with moveable target 40*c* it may still be able to proceed along a spiral trajectory along funnel 30 because moveable target 40*c* absorbs the shock of the interaction rather than stopping coin 22. This is also true with the paddle target embodiment of FIG. 5*b*.

Figure 5D:
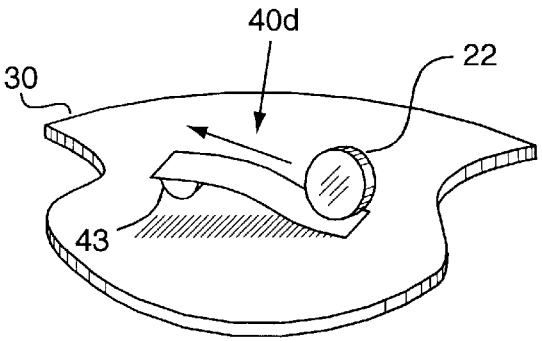
FIG. 5*d* shows a target that includes a ramp target, in accordance with an embodiment of the present invention.

FIG. 5*d* shows a target that includes a ramp 40*d*, in accordance with another embodiment of the present invention. Coin 22 may be guided along a path along funnel 30 such that it will roll over ramp 40*d*. As coin 22 rolls over ramp 40*d* it may cause ramp 40*d* to depress under the weight of coin 22. The depression of ramp 40*d* may cause a sensor 43 located on the underside of ramp 40*d* to actuate. Sensor 43 may be coupled to a CPU or other control circuitry to allow interactive funnel amusement device 20 to register the interaction between coin 22 and ramp 40*d*.

Figure 5E:
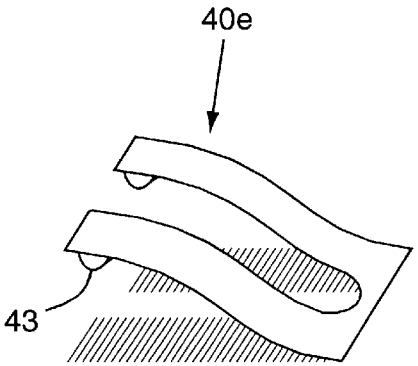
FIG. 5*e* shows a target that includes a dual ramp target, in accordance with an embodiment of the present invention.

FIG. 5*e* shows an alternate embodiment of ramp 40*d*, in accordance e with another embodiment of the present invention in which a dual ramp 40*e* is provided. Dual ramp 40*e* allows coin 22 to roll between the ramps or around them. Dual ramp 40*e* can include multiple sensors 43 to detect when coin 22 rolls over either of the ramps. In alternate embodiments, any number of ramps can be used in a similar fashion. The different ramps can be valued differently with regard to scoring to provide a greater variety of interaction between the user and the amusement device 20.

Figure 5F:
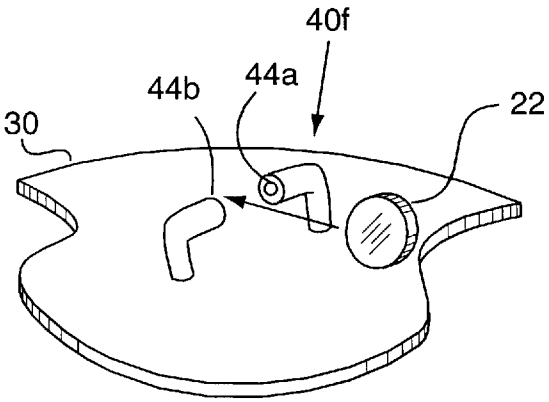
FIG. 5*f* shows a target that includes an emitter-detector target, in accordance with an embodiment of the present invention.

FIG. 5*f* shows a target that includes an emitter-detector. Emitter-detector target 40*f* includes an emitter 44*a* and a detector 44*b*. Emitter 44*a* typically emits an electromagnetic signal or beam that is received by detector 44*b*. If the electro-magnetic signal is interrupted, then emitter-detector pair 44*a* and 44*b* will register the disruption in the electromagnetic signal. Emitter-detector pair 44*a* and 44*b* may be coupled to a CPU or other control circuitry to pass along the detected interruption of the electro-magnetic signal. A user may guide coin 22 to pass between emitter-detector pair 44*a* and 44*b*, thereby triggering the emitter-detector pair.

Figure 5G:
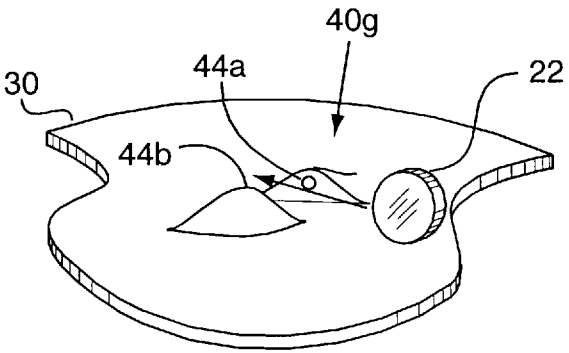
FIG. 5*g* shows a target that includes an emitter-detector target pair concealed in bumps, in accordance with an embodiment of the present invention.

FIG. 5*g* shows a target that includes an emitter-detector pair concealed in bumps 40*g*. Bumps 40*g* operate similarly to emitter-detector pair target 40*f*, as previously described, in addition, the emitter-detector pair 44*a* and 44*b* are concealed within bumps 40*g*. Bumps 40*g* allow coin 22 to pass between emitter-detector pair 44*a* and 44*b*. If coin 22 does not pass between emitter detector pair 44*a* and 44*b* it is not significantly impeded from traveling along its original trajectory. That is, coin 22 may simply roll over bumps 40*g* rather than running into an obstacle due to the smooth, rounded surface of the bumps. Thus, a user may be entertained with coin maneuvers even though the coin has not passed directly between emitter-detector pair 44*a* and 44*b*.

Figure 5H:
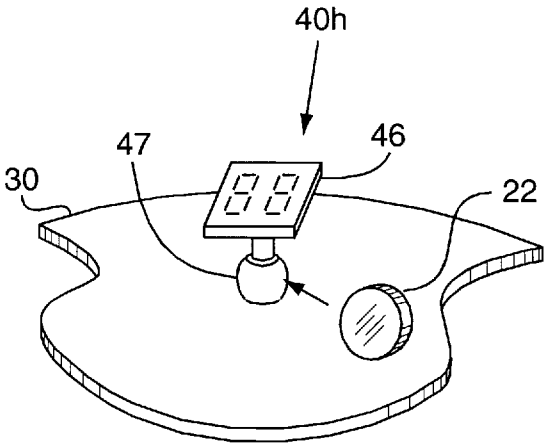
FIG. 5*h* shows a display target, in accordance with another embodiment of the present invention.

FIG. 5*h* shows a display target 40*h*. Display target 40*h* may include a display 46 coupled to interacting portion 47. Coin 22 may be guided along a path to interact with interactive portion 47 of display target 40*h*. Interactive portion 47 can be any of the types of interactions discussed herein. In one embodiment coin 22 simply interacts with interactive portion 47 by hitting interactive portion 47. Once coin 22 and interactive portion 47 have interacted an appropriate visual effect may be displayed on display 46. Again, display target 48 may be coupled to a CPU, or other control circuitry, such that the interaction between coin 14 and display target 40*h* is registered and recorded.

Figure 5I:
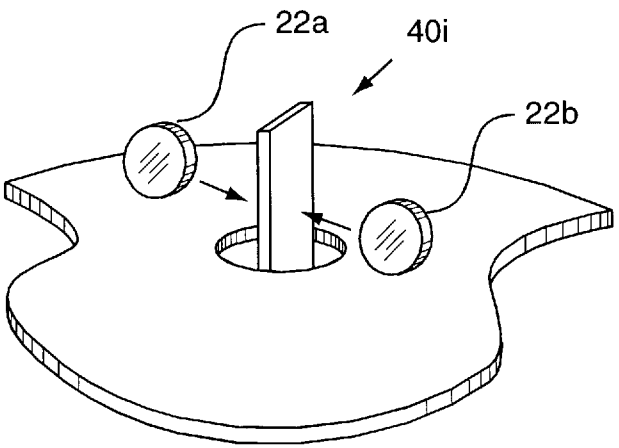
FIG. 5*i* illustrates a bi-directional target, in accordance with another embodiment of the present invention.

FIG. 5*i* illustrates a bi-directional target 40*i*, in accordance with another embodiment of the present invention. Bi-directional target 40*i* is a planar paddle that can be actuated from either side. On either side of bi-directional target 40*i* are sensors (not shown) that detect the motion of the bi-directional target, as is well known in the art. The sensors not only detect whether the bi-directional target was actuated, but also from which direction. Coin 22 can be rolling in a clockwise (coin 22*a*) or counterclockwise (coin 22*b*) direction and actuate the bi-directional target.

Figure 6:
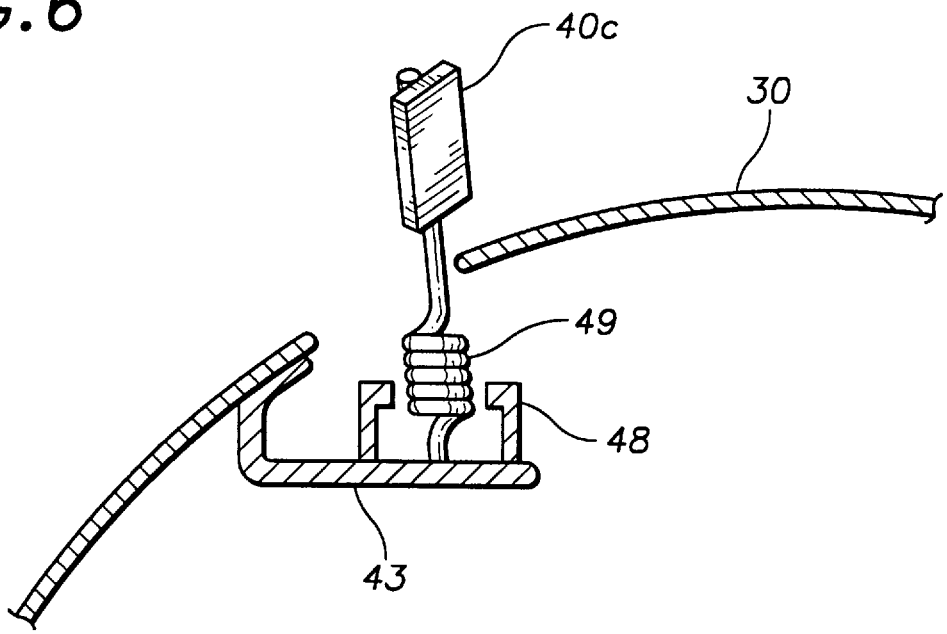
FIG. 6 is a cross-sectional view of the moveable target depicted in FIG. 5*c*, in accordance with an embodiment of the present invention.

FIG. 6 is a cross-sectional view of moveable target 40*c* as depicted in FIG. 5*c*, in accordance with an embodiment of the present invention. Moveable target 40*c* includes a spring portion 49. Moveable target 40*c* is attached to a support member 43 which is further coupled to the underside of funnel 30. Moveable target 40*c* is attached to support member 43 such that the target protrudes from hole 42, and a coin 22 is able to interact with moveable target 40*c*. Also attached to support member 43 are target sensors 48. Target sensors 48 are located about moveable target 40*c* such that when coin 22 interacts with moveable target 40*c*, target sensors 48 will detect the interaction. By way of example, the illustrated target sensor detects the movement of the spring portion 49 of moveable target 40*c*.

While the illustrated embodiment of target sensors 48 are related to moveable target 40*c*, any suitable type of target sensors 48 may be used with any of the various types of targets 40*a–h* described. For example, emitter-detector pair 44*a* and 44*b* are one type of target sensors 48 that are suitable for certain types of targets, as is sensor 43, utilized with ramp targets 40*d* and 40*e*. Target sensors 48 may be coupled to a CPU or other control circuitry within interactive funnel amusement device 20.

Figure 7:
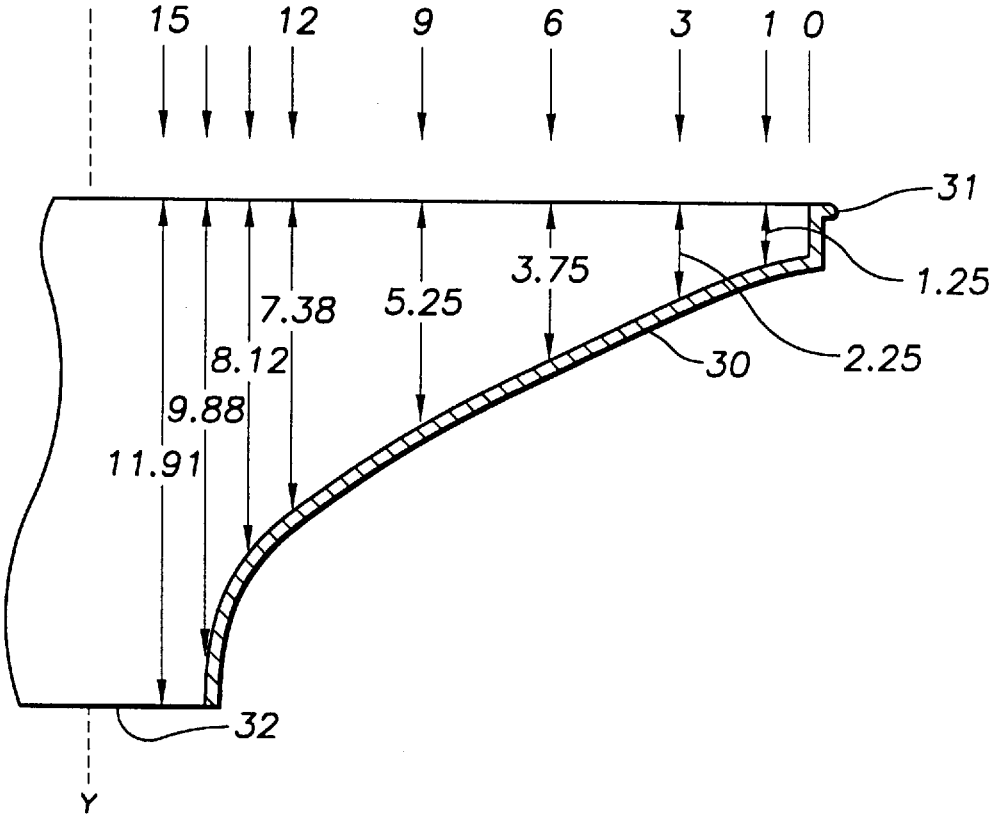
FIG. 7 is a cross-sectional side view of a portion of an exemplary funnel of the interactive funnel amusement device, in accordance with an embodiment of the present invention.

FIG. 7 is a cross-sectional side view of a portion of funnel 30, in accordance with an embodiment of the present invention. One half of the funnel is shown, where preferably the other half is substantially similar. Funnel 30 includes an upper opening 31 and a lower opening 32. The shape of funnel 30 from upper opening 31 down towards lower opening 32 is important in order to provide a user and/or an observer a satisfactory amount of entertainment. Thus, the slope of funnel 30 may be arranged in any suitable shape that allows a coin, or other rolling or sliding object, to spiral down funnel 30 in an amusing manner. FIG. 7 depicts one orientation of funnel 30 that has been found to provide an entertaining effect, in accordance with an embodiment of the present invention. FIG. 7 provides the approximate depth of funnel 30 according to a distance from an edge of upper opening 31 to the center axis of funnel 30 as depicted by a Y axis. The dimensions of funnel 30 is designed to create a maximum amount of coin roll.

Figure 8A:
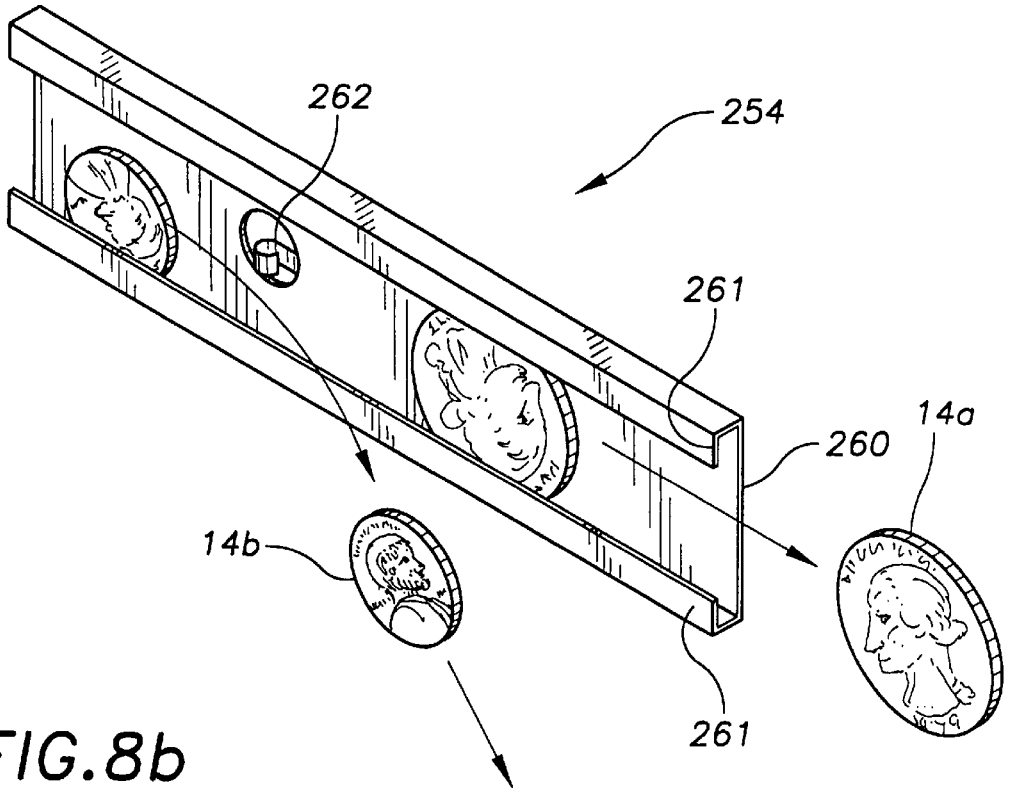
FIG. 8a PRIOR ART
FIG. 8*a* depicts a prior art coin guide.
Figure 8B:
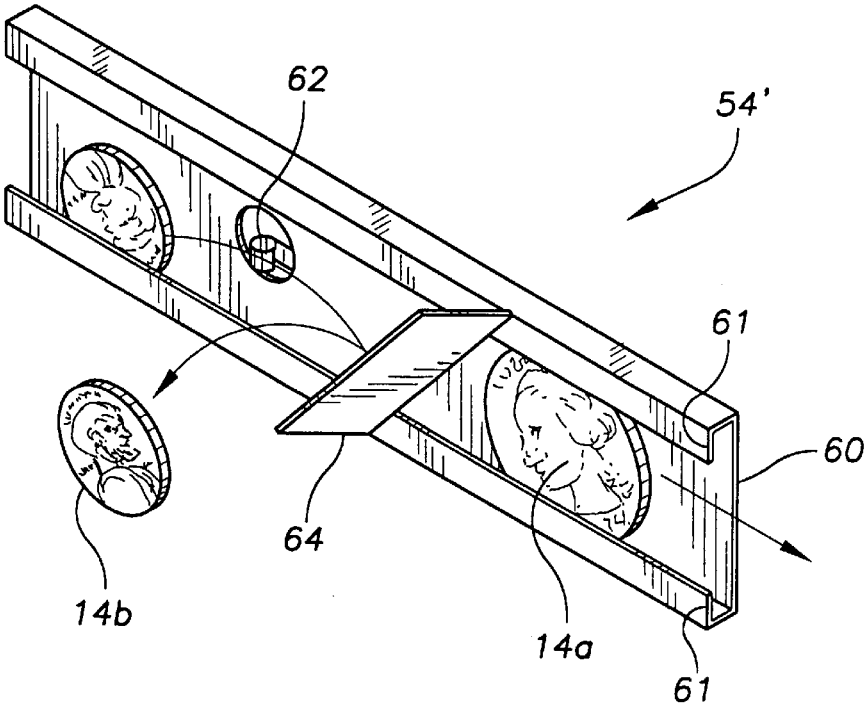
FIG. 8b PRIOR ART
FIG. 8*b* depicts an improved coin guide, in accordance with an embodiment of the present invention.

Referring to FIGS. 8*a* and 8*b*, another aspect of the present invention is a unique coin guide member 254. FIG. 8*a* depicts a prior art coin guide 254. The prior art coin guide 254 includes a guide member 260 and a coin ejector 262. Guide member 260 may be shaped to allow a particularly sized coin, such as coin 14*a*, to roll through the guide member. However, coin guide 2 should be able to reject smaller coins, such as coin 14*b*, in order to prevent users from utilizing inappropriately sized coins within the interactive funnel amusement device 20. Therefore, coin guide 254 typically includes a coin rejecter 262.

Coin rejecter 262 protrudes slightly into the plane of guide member 260 to apply a force onto the coin passing through guide member 260, the force being directed approximately perpendicularly to the direction of coin travel. Guide member 260 includes flanges 261 which keep appropriately-sized coin 14*a* from falling out of guide member 260 when coin rejecter 262 applied a force to coin 14*a* as it passes through guide member 260. However, when a smaller coin 14*b* passes through guide member 260, coin rejecter 262 forces smaller coin 14*b* out of guide member 260. This is because when smaller coin 14*b* passes by coin rejecter 262 only one of flanges 261 is in contact with smaller coin 14*b*, which is not efficient to prevent smaller coin 14*b* from being ejected from guide member 260.

Typically, the prior art coin guide 254 is suitable for rejecting smaller coin 14*b*; however, smaller coin 14*b* is typically ejected along a trajectory towards the distal end of coin guide 254. In cases where the distal end of coin guide 2 is aimed towards the amusement device, ejected smaller coins 14*b* may still interact with the rest of the amusement device, e.g., by landing into a funnel or playing field. Therefore, it is desired to deflect smaller coins 14*b* once they are rejected by coin rejecter 62 in order to prevent smaller coins 14*b* from interacting with the playing field of the amusement device, such as a funnel.

FIG. 8*b* depicts an improved coin guide 54" in accordance with the present invention. The improved coin guide 54" includes a guide member 60 with flanges 61, a coin rejecter 62 and a deflector 64. Improved coin guide 54" operates similar to the prior art coin guide 254, but with the added functionality of deflector 64. Once smaller coin 14*b* is ejected from guide member 60 by coin rejecter 62, smaller coin 14*b* is propelled towards deflector 64. Smaller coin 14*b* will then impact deflector 64 and bounce off in a direction away from the distal end of improved coin guide 54". The smaller coin 14*b* is thereby prevented from interacting with the amusement device other than with the coin repository for collecting rejected coins. Improved coin guide 54" can also include a coin guide switch (not shown) to sense the entry of a proper coin.

Figure 9:
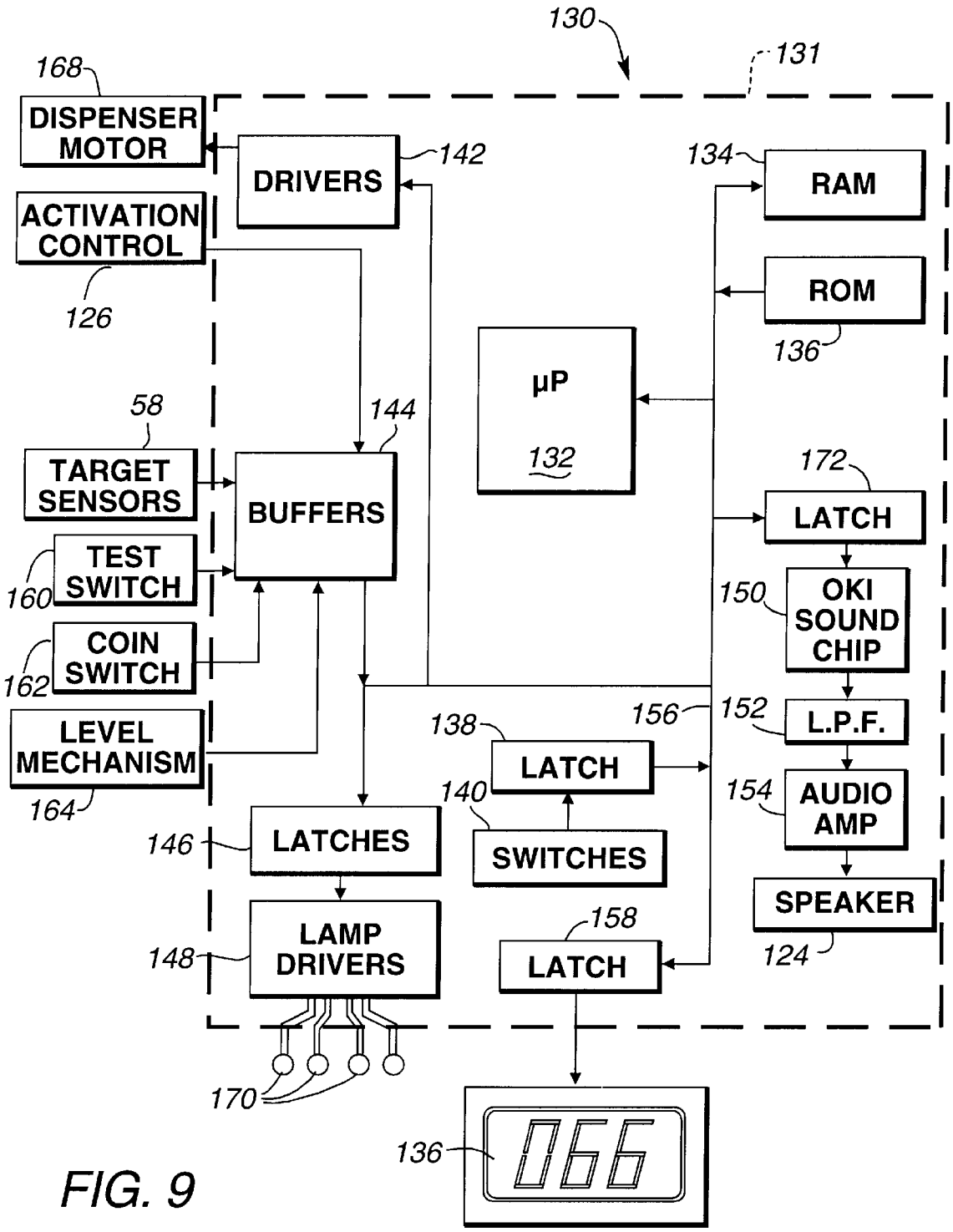
FIG. 9 is a block diagram of a control system of an interactive funnel amusement device, in accordance with an embodiment of the present invention.

FIG. 9 is a block diagram of a control system 130 of interactive funnel amusement device 20. The control system, for example, can be implemented on one or more printed circuit boards 131 which can be located in the interior of interactive funnel amusement device 20, for example, on a side in the interior of the device. The components of control system 130 include a microprocessor 132, random access memory (RAM) 134, read-only memory (ROM) 136, a latch 138, DIP switches 140, a game score display 141, drivers 142, buffers 144, latches 146, lamp drivers 148, sound chip 150, low pass filter 152, audio amplifier 154, and speaker 124.

Microprocessor 132 controls the operations of game apparatus 10. Any suitable microprocessor which has the range of features adequate for the task can be used in accordance with the present invention. The microprocessor preferably, includes eight data lines and sixteen address lines and executes software instructions that can be stored in memory, as explained below. Microprocessor 132 is coupled to ROM 136 by a data/address/control bus 156. The ROM 136 is preferably an erasable, programmable read-only memory (EPROM) that contains the start-up instructions and operating system for the microprocessor 132. Microprocessor 132 is connected to RAM 134 by bus 156 to permit the use of RAM for scratch-pad memory. Methods for coupling ROM 136 and RAM 134 to the microprocessor 132 by bus 156 including enable, address, and control lines are well-known to those skilled in the art.

The microprocessor 132 is also coupled to a latch 138 by the bus 156. The switches 140 coupled to latch 138 provide selectable game functions that the operator of the game unit may change to his or her liking. These selectable functions can include the amount the score is incremented when a coin interacts with a particular target 40, the amount of tickets dispensed based on the score, the conditions required to add to the game score and/or receive an award, the conditions required for a player to win a progressive bonus award, etc. These factors can affect the difficulty of the amusement device and the amount of awards received by players. Other functions selectable by switches 140 can include sound effects, the test mode, the type of game, and so on, depending on how many selectable functions are desired. Switches 140 can, for example, be implemented as DIP switches. Alternatively, the functions selected by switches 140 can be selected from another input device, such as a control panel or keyboard of buttons, or through software commands to the microprocessor 132.

Microprocessor 132 is also coupled to score display 141. The bus 156 connecting the microprocessor 132 to the score display 141 is latched by a latch 158. The score display can be a 7-segment LED digit display or similar display.

Microprocessor 132 is also coupled to drivers 142 and buffers 144. Buffers 144 receive data from several switches and sensors, including test switch 160, a coin guide switch 162, a level mechanism 164, and target sensors 58. Test switch 160 can be a switch located in the interior of game apparatus 10 accessible to the operator which activates a test mode for interactive funnel amusement device 20 to determine if the device is operating correctly. Coin guide switch 162 detects when a coin has been inserted into coin guide 50 of the device. Level mechanism 164 can detect when the entire game apparatus 10 has been moved or tilted past a designated level so that microprocessor 132 can stop a game when such movement is detected. Target sensors 58 detect the interaction of coin 22 with targets 40. Drivers 142 activate and drive output devices including a dispenser motor 168 for dispensing tickets 69 from ticket dispensing device 68.

The microprocessor 132 is also coupled to latches 146 which latch data for lamp drivers 148. The lamp drivers 148 supply power to lamps 170, which include, for example, light sources for lights 171 and illuminating indicators 38 when a coin interacts with a target 40 or to indicate to the player which targets 40 should receive coins to modify game score. Lamps 170 can also include additional lamps provided on or around the perimeter of front panel 12, funnel 30, and other similar areas of interactive funnel amusement device 20 which can be highlighted as part of game action. In the preferred embodiment, components such as the dispenser motor 168 and lamps 170 are powered by a commercially available 110 V AC power supply and power converters, which are well known in the art.

The microprocessor 132 is also coupled to a sound chip 150 which can be, for example, an OKI Voice Synthesis LSI chip available from OKI Semiconductor of San Jose, Calif. that has eight data input lines coupled to the microprocessor 132 by a latch 172. The sound chip 150 can receive its data from ROMs (not shown) and preferably outputs sound data to a low pass filter 152, an audio power amplifier 154, and finally to the output speaker(s) 124, which generate sounds to the player playing the interactive funnel amusement device 20, as is well known to those skilled in the art.

A preferred embodiment of the control system 130 operates briefly as follows. The microprocessor 132 first reads the low memory from ROM 136 over bus 156 and sequences through the software instructions stored in ROM. The settings of switches in the switches block 140 are also read into the microprocessor. The software from the ROM 136 then instructs the microprocessor 132 to send and receive data over the bus 156 in order to wait for a game to begin and to conduct a game. For example, when the coin guide switch 162 is activated, indicating a coin has been inserted into coin guide 50, the microprocessor receives a signal from buffers 144 on bus 156. The microprocessor reads information from target sensors 58 through buffers 144 to determine which targets 40 have interacted with a coin. During game play, the microprocessor sends appropriate output signals over bus 156 to update game score display 141 and activate speaker 124 and lamps 170. Once the game is over, the microprocessor activates dispenser motor 168 through drivers 142. The method of operation of the preferred embodiment of the game apparatus is described in greater detail with respect to FIG. 10.

Figure 10:
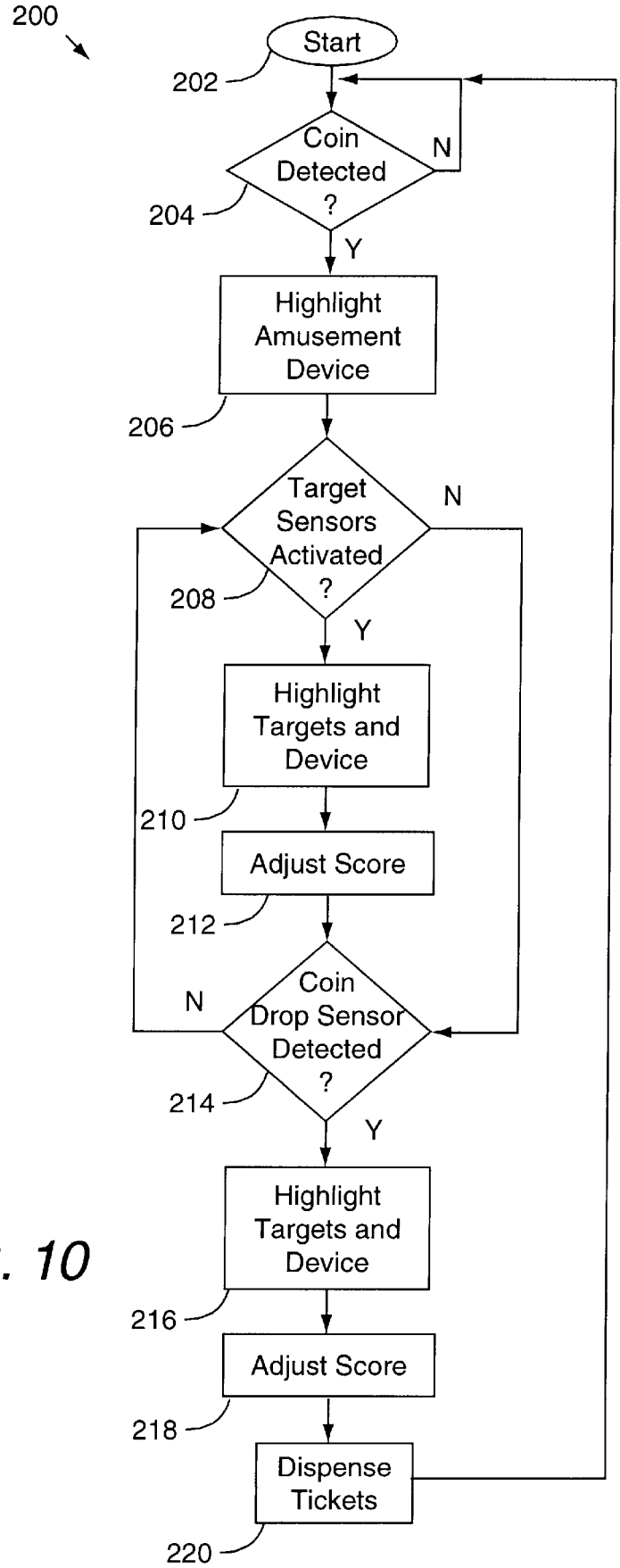
FIG. 10 is a flow diagram illustrating a method of operating and playing the embodiment of the interactive funnel amusement device described in reference to FIG. 9, in accordance with an embodiment of the present invention.

FIG. 10 is a flow diagram illustrating a method 200 of operating and playing the described embodiment of interactive funnel amusement device 20. The process begins at 202. In block 204, the microprocessor checks if a coin has been inserted into coin guide 50 by checking a signal from coin guide switch 162. If no coin is detected, step 204 is repeated until a coin is detected. It is at this time, typically, that the player is carefully aiming coin guide 50 to ensure that the coin being dropped into the guide will interact with a target 40. Once the player has taken careful aim the player lets go of the coin in the coin guide.

Once a coin is detected by coin guide switch 162 in block 206, CPU 132 activates display 136, lamps 170, and speaker 124 to entertain and enthrall the player and any passers-by. The display, lamps and speakers are coordinated by CPU 132 to provide an amusing display of sights and sounds while the coin rolls along the inner surface of funnel 30. At the same time, CPU 132 checks the appropriate part of buffers 144 to determine if the coin has activated any target sensors 58.

Should the player be so unfortunate that no interactions between the coin and target sensors 58 are detected, in block 214 CPU 132 determines if the coin has dropped through the bottom of funnel 30, thereby triggering coin drop sensor 62. However, if the player is sufficiently skillful and a coin-target interaction occurs, CPU proceeds to block 210. In block 210 certain lamps 170 which highlight illuminating indicators 38 are activated to indicate which target 40 has interacted with the coin. Additionally, other lamps 170 and speaker 124 can be activated to further reward the player for his or her skill. In block 212 display 141 is updated to indicate a score for interacting with a target 40. The score can be any suitable display, such as an individual target score, a current score or a cumulative score. After lighting up the appropriate parts of interactive funnel amusement device 20, CPU 132 again checks to determine if the coin has activated coin drop sensor 62 in block 214. If the coin has not dropped through the bottom of funnel 30, CPU 132 returns to block 208 to detect further coin/target interactions.

When the coin has fallen through the bottom of funnel 30, CPU 132 proceeds to block 216. In block 216 CPU 132 once again activates lamps 170 and speaker 124 to indicate that the game is over. By way of example, lamps located about the interactive funnel amusement device can be turned off, or varied to entice further play. Speaker 124 can output a crescendo of sound to indicate the end of the game, followed by enticing sounds to prompt more game play. While the lights and sounds continue, CPU 132 proceeds to block 218 to change the display of display 136 to show the final score of the game. Depending on the score, CPU 132 activates dispenser motor 168 in block 220 to dispense tickets 69. For example, the number of dispensed tickets can be based on the final game score value. CPU 132 then returns to block 204 to await the insertion of more coins.

In other embodiments, tickets from ticket dispensing device 68 can be dispensed at different times during the game process 200. For example, tickets based on the game score can be dispensed to the player after each coin/target interaction or after all coin/target interactions, and then tickets based on the progressive score can be dispensed or manually provided by an operator of the game apparatus. The tickets can be used, for example, to redeem prizes. In another embodiment, any type of award can be dispensed other than tickets. Awards such as additional coins for further play, prizes, game tokens, prize credits, etc. can be dispensed to provide greater amusement to the player.

In one embodiment a progressive score can be utilized in accordance with the present invention. Progressive scoring is described in detail in U.S. Pat. No. 5,292,127, by Kelly et al. and entitled "ARCADE GAME," which is incorporated herein by reference in its entirety.

In an alternate embodiment, interactive funnel amusement device 20 can be played with any type of rolling or sliding object other than a coin. While a coin is the most usual type of rolling or sliding object to watch as it spirals down funnel 30, other types of rolling or sliding objects can be employed. As discussed, small balls, cylinders, objects with wheels, among others, can be used in accordance with the present invention. Also, as discussed, any type of target 40 can be used, corresponding to the type of rolling or sliding object employed, to provide amusing interactions.

Figure 11:
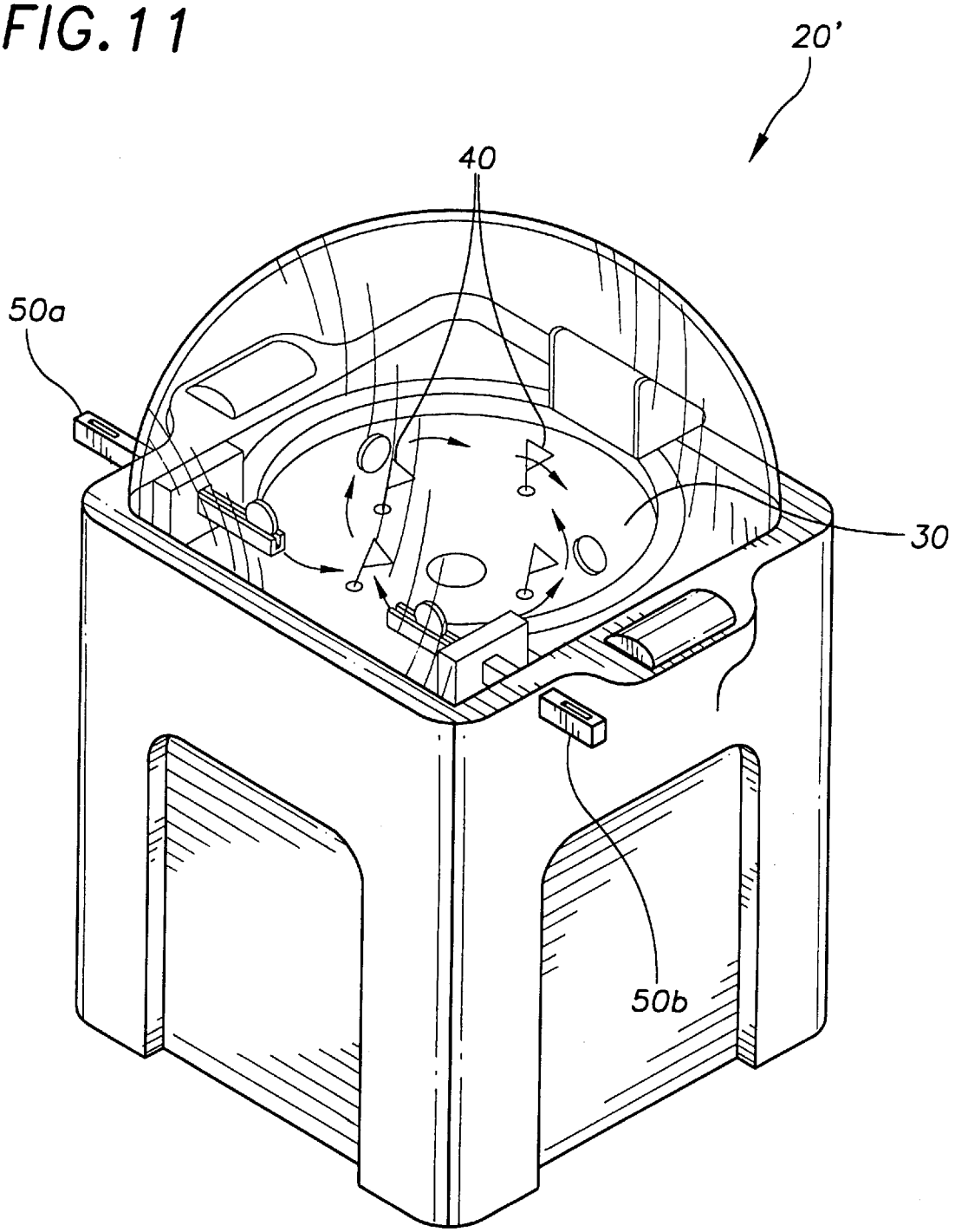
FIG. 11 is a perspective view of a two player interactive funnel amusement device in accordance with another embodiment of the present invention.

Another embodiment of the present invention is a two player interactive funnel amusement device 20" as shown in FIG. 11. FIG. 11 is a perspective view of a two player interactive funnel amusement device 20". Two player interactive funnel amusement device 20" includes two coin guides 50*a* and 50*b*. A player can roll coins counter-clockwise on funnel 30 using coin guide 50*a*, while an opponent rolls coins clockwise using coin guide 50*b*. The players can compete to interact with as many targets 40 as possible.

In one embodiment, bi-directional target 40*i* is utilized to allow for independent scoring. Additionally, the other variants of targets 40*a*–40*h* can be modified to allow for independent scoring as well as other types of targets. Hole target 40*a* can be equipped with sensors to determine the direction from which coin 22 has fallen into the hole target. Paddle target 40*b* can include sensors on the paddle to determine on which side of the paddle the coin has actuated, combined with the resulting rotation, it can be determined which player actuated the target. Movable target 40*c* can be equipped with multiple sensors, similar to bi-directional target 40*i*. Ramp targets 40*d* and 40*e* can be bi-directional ramps with extra sensors to determine which side of the bi-directional ramp the coin has actuated. Emitter-detector targets 40*f* and 40*g* can be equipped to determine the motion of the interacting coin in addition to the fact that the coin interrupted the signal. Additionally, the coins can be color coded, or contain other types of coding, that allow the emitter-detector target to identify different coins. And, display target 40*h* can have multiple sensors within interacting portion 47 to determine the direction of the interacting coin. In the foregoing examples, as well as other known methods of determining individual coins, independent scoring is accomplished.

Two player interaction provides even greater interaction between players, observers and the funnel amusement device. Further, in alternate embodiments, any suitable number of players may be allowed to participate in a single funnel amusement device. Previous devices lacked any type of significant interaction for a single participant, let alone multiple participants. The present invention, thereby, provides a great amount of enjoyment to all participants.

While this invention has been described in terms of several preferred embodiments, there are alterations, permutations, and equivalents which fall within the scope of this invention. It should also be noted that there are alternative ways of implementing both the method and apparatus of the present invention. It is therefore intended that the following appended claims be interpreted as including all such alterations, permutations, and equivalents as fall within the true spirit and scope of the present invention.

What is claimed is:

1. An amusement device comprising:

a funnel having a substantially circular cross-section, an interior surface, a first opening, and a second opening, wherein the first opening is larger than the second opening and is oriented vertically above the second opening, the funnel sloping downward and inward from the first opening to the second opening a pivotably adjustable guide for aiming a rollable object in one of a plurality of trajectories along the interior surface of the funnel such that the object rolls approximately from the first opening down to the second opening in a substantially spiral manner: and a target located on the interior surface of the funnel, wherein the object is capable of interacting with the target as the object rolls down the funnel.

2. An amusement device as recited in claim 1, wherein the sloping of the funnel is a curve.

3. An amusement device as recited in claim 1, wherein the sloping of the funnel is a linear slope.

4. An amusement device as recited in claim 1, wherein the adjustable guide has a twist such that when the object travels through the adjustable guide the object obtains a tilt.

5. An amusement device as recited in claim 4, wherein the twist corresponds to the sloping of the funnel such that when the object exits the guide the tilt of the object is substantially perpendicular to the interior surface of the funnel.

6. An amusement device as recited in claim 4, wherein the tilt is an angle in the range of approximately zero to thirty degrees.

7. An amusement device as recited in claim 4, wherein the tilt is an angle in the range of ten to twenty degrees.

8. An amusement device as recited in claim 7, wherein the tilt of the guide is adjustable.

9. An amusement device as recited in claim 1, wherein the object falls into the second opening at substantially the horizontal orientation to the interior surface of the funnel.

10. An amusement device as recited in claim 9, wherein the guide includes a first hinge for rotating the guide along a substantially horizontal plane, whereby the guide is adjustable such that the object moves along the selected one of a plurality of trajectories along the interior surface of the funnel.

11. An amusement device as recited in claim 9, wherein the guide includes a second hinge for rotating the guide along a substantially vertical plane, whereby the guide is adjustable such that the object moves along the selected one of a plurality of trajectories along the interior surface of the funnel.

12. An amusement device as recited in claim 11, wherein the guide further includes an adjustable elevator that sets an angle of vertical rotation of the guide, such that the speed of the object as the object is being guided down the guide is controlled by the angle of vertical rotation.

13. An amusement device as recited in claim 12, wherein the tilt of the object is adjustable, and the adjustable elevator also sets the tilt.

14. An amusement device as recited in claim 9, wherein the guide is adjustable such that the object is guided along a subset of trajectories of the plurality of trajectories along the interior surface of the funnel such that the object interacts with the target located on the interior surface of the funnel.

15. An amusement device as recited in claim 1, wherein the target does not substantially impede the object from continuing to roll down the interior surface of the funnel upon the interaction.

16. An amusement device as recited in claim 1, wherein the guide is suitable for guiding a substantially disc-shaped object.

17. An amusement device as recited in claim 1, wherein the guide is suitable for guiding a substantially spherical object.

18. An amusement device as recited in claim 16, wherein the guide is suitable for guiding a substantially first disc-shaped object having a first size and the guide rejects a second substantially disc-shaped object having a second size that is smaller than the first size, the guide having a proximal end and a distal end, the object being guided from the proximal end to the distal end towards the funnel, and a rejection barrier such that when the second disc-shaped object is rejected the second disc-shaped object is directed away from the distal end of the guide such that the second disc-shaped object does not proceed towards the funnel.

19. An amusement device as recited in claim 1, wherein the target includes a sensor such that when the object interacts with the target the sensor operative to detect the interaction.

20. An amusement device as recited in claim 1, wherein the target includes an emitter-detector pair such that the object interacts with the target by passing through an electromagnetic beam being transmitted between the emitter-detector pair.

21. An amusement device as recited in claim 1, wherein the target includes a hole and the object interacts with the target by falling in the hole.

22. An amusement device as recited in claim 1, wherein the target includes a ramp and the object interacts with the target by rolling over the ramp.

23. An amusement device as recited in claim 19, wherein the amusement device further includes control circuitry, the sensor coupled to the control circuitry such that when the sensor detects that the object has interacted with the target, the sensor informs the control circuitry.

24. An amusement device as recited in claim 23, wherein the control circuitry includes a central processing unit.

25. An amusement device comprising:

a funnel having a substantially circular horizontal cross-section, an interior surface, a first opening, and a second opening, wherein the first opening is larger than the second opening and the first opening is oriented above the second opening, the funnel sloping from the first opening to the second opening such that an object capable of rolling rolls around the interior surface in a substantially spiral manner in a direction from the first opening toward the second opening; and a pivotably adjustable guide for introducing the object on one of a plurality of trajectories along the interior surface of the funnel, each trajectory moving the object in a substantially spiral manner.

26. An amusement device as recited in claim 25, wherein the adjustable guide is capable of aiming the object on a selected one of the plurality of trajectories.

27. An amusement device as recited in claim 25 further comprising a target located on the interior surface of the funnel.

28. An amusement device as recited in claim 26, wherein the adjustable guide is capable of aiming the object on the selected one of the plurality of trajectories that allows the object to interact with a target located on the interior surface of the funnel as the object rolls down the funnel.

29. An amusement device comprising:

a funnel having a substantially circular horizontal cross-section, an interior surface shaped between a first elevation and a second elevation such that a playing piece moves around the interior surface in a substantially spiral manner in a direction from the first elevation toward the second elevation;

a target located on the interior surface of the funnel, wherein the object is capable of interacting with the target as the object rolls down the funnel; and a pivotable adjustable guide for introducing the object on one of a plurality of trajectories along the interior surface of the funnel each trajectory being provided in a substantially spiral configuration.

30. An amusement device as recited in claim 29, the amusement device further including a central processing unit, wherein the central processing unit is coupled to the target such that the central processing unit is capable of detecting when the object interacts with the target.

31. A guide for use in an amusement device, the guide comprising:

a guide member having a proximal end and a distal end;

a channel substantially extending from the proximal end to the distal end of the guide member, wherein the guide member guides a first substantially disc-shaped object having a first size through the channel such that the first disc-shaped object is in play in the amusement device;

a rejecter disposed adjacent to the channel such that the rejecter is capable of rejecting a second disc-shaped object, the object having a second size that is smaller than the first size, traveling through the channel; and a rejection barrier positioned relative to said rejecter, wherein when the rejecter rejects the second disc-shaped object the second object is directed away from the distal end of the guide by the rejection barrier such that the second disc-shaped object does not interact with the amusement device to provide amusement.

32. A guide as recited in claim 31, wherein the guide member is substantially linear between the proximal and the distal ends.

33. A guide as recited in claim 31, wherein the rejection barrier is a deflector coupled to the guide in a plane that is orthogonal to a plane of the guide member.

34. A guide as recited in claim 31 further comprising an extended guide member coupled to distal end of the guide member, the extended guide member having an extended guide channel, wherein the guide member guides the first disc-shaped object from the channel of the guide member to the extended guide channel.

35. A guide as recited in claim 34, wherein the guide member directs the first disc-like member along a first trajectory and the extended guide member redirects the first disc-like object from the first trajectory to a second trajectory.

36. An extended guide for guiding an object along a plurality of trajectories in an amusement device, the guide comprising:

a guide portion having a proximal end, a distal end and a first channel, the channel substantially extending from the proximal end to the distal end of the guide portion, wherein the guide portion guides an object through the first channel from the proximal end to the distal end along a first trajectory; and an extended portion having a proximal end and a second channel, the proximal end of the extended portion being coupled to the distal end of the guide portion to receive the object from the guide portion, wherein the extended portion guides the object along the second channel by redirect the object from the first trajectory to a second trajectory, wherein the extended guide is pivotably adjustable to guide the object onto a playing field of the amusement device along one of the plurality of trajectories.

37. An extended guide for use in an amusement device as recited in claim 36, wherein the amusement device is a funnel type amusement device and the playing field includes a funnel, such that the extended guide guides the object along the second trajectory such that the object rolls along an interior surface of the funnel in a substantially spiral manner.

38. An extended guide as recited in claim 36, wherein the object is a coin.

39. An extended guide as recited in claim 36, wherein the object is a substantially spherically shaped object.

40. An extended guide as recited in claim 36, wherein the extended portion is angled.

41. An extended guide as recited in claim 36, wherein the extended portion is curved.

42. An extended guide as recited in claim 36, wherein the extended portion is twisted.

43. An extended guide as recited in claim 36, wherein the first and second trajectories have a first and a second horizontal component, respectively, and the second horizontal component is different from the first horizontal component.

44. An extended guide as recited in claim 36, wherein the first and second trajectories have a first and a second vertical component, respectively, and the second horizontal component is different from the first vertical component.

45. An extended guide as recited in claim 36, wherein the first and second trajectories have a first and a second angular component, respectively, and the second horizontal component is different from the first angular component.

46. An extended guide as recited in claim 36, wherein the guide portion is twisted.

47. A method for providing an amusement funnel device, comprising:

providing a substantially circular funnel having an interior surface, wherein an object may roll along one of a plurality of trajectories on the interior surface of said funnel in a substantially spiral manner;

a pivotably receiving the object in an adjustable guide; and adjustable guiding the object in said adjustable guide on a selected trajectory along the interior surface of the funnel in a substantially spirial manner, the selected trajectory of the object alone the interior surface of the funnel being determined based on a position of said adjustable guide selected by a player of the amusement device.

48. A method as recited in claim 47, further comprising:

providing a target on the interior surface of the funnel, wherein the object is cable of interacting with the target as the object rolls down the funnel; and detecting an interacting of the object with the target.

49. A method as recited in claim 48, further comprising:

adjusting a game score based on the interaction of the object with the target.

50. An amusement device comprising:

a funnel means for providing a surface for an object to roll in a substantially spiral manner from a first elevation to a second elevation, wherein the first elevation is higher than the second elevation;

a pivotably adjustable guide means for aiming the object on one of a plurality of trajectories along the surface of the funnel means; and a target means located on the funnel means for interacting with the object.

* * * * *

UNITED STATES PATENT AND TRADEMARK OFFICE

CERTIFICATE OF CORRECTION

PATENT NO. : 5,888,115
DATED : March 30, 1999
INVENTOR(S) : Shoemaker, Jr. et al.

It is certified that error appears in the above-indentified patent and that said Letters Patent is hereby corrected as shown below:

Column 1, line 9, change "Petenneier" to --Petermeier--
Column 3, Line 28, change "a long" to --along--
Column 6, line 45, change "usefull" to --useful--

Column 18, line 19, change "redirect" to --redirecting--
Column 18, line 64, after "manner;" delete "a pivotably"
Column 18, line 66, change "adjustable" to --adjustably--
Column 19, line 1, change "spirial" to --spiral--
Column 19, line 2, change "alone" to --along--
Column 19, line 8, change "cable" to --capable--
Column 19, line 10, change "interacting" to --interaction--

Signed and Sealed this

Twenty-fourth Day of August, 1999

*Attest:*

Q. TODD DICKINSON

*Attesting Officer*

*Acting Commissioner of Patents and Trademarks*